US010297271B1

(12) United States Patent
Anders

(10) Patent No.: US 10,297,271 B1
(45) Date of Patent: May 21, 2019

(54) ACCURATE EXTRACTION OF CHROMA VECTORS FROM AN AUDIO SIGNAL

(71) Applicant: Google Inc., Mountain View, CA (US)

(72) Inventor: Pedro Gonnet Anders, Zurich (CH)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/823,357

(22) Filed: Nov. 27, 2017

Related U.S. Application Data

(63) Continuation of application No. 14/754,461, filed on Jun. 29, 2015, now Pat. No. 9,830,929.

(60) Provisional application No. 62/018,634, filed on Jun. 29, 2014.

(51) Int. Cl.
*G10L 25/03* (2013.01)

(52) U.S. Cl.
CPC ..... *G10L 25/03* (2013.01)

(58) Field of Classification Search
None
See application file for complete search history.

(56) References Cited

U.S. PATENT DOCUMENTS

| | | | | |
|---|---|---|---|---|
| 9,471,673 | B1 | 10/2016 | Sharifi et al. | |
| 2013/0035933 | A1 | 2/2013 | Hirohata | |
| 2013/0139674 | A1* | 6/2013 | Whitman | G10H 1/00 84/609 |
| 2013/0226957 | A1* | 8/2013 | Ellis | G06F 17/30758 707/769 |

OTHER PUBLICATIONS

Muller, Meinard, et al. "Audio Matching Via Chroma-Based Statistical Features." Jan. 2005.*
Goto, Masataka. "A Chorus-Section Detecting Method for Musical Audio Signals." IEEE, 2003.*
Ellis, Daniel P.W. et al., "Identifying 'Cover Songs' With Chroma Features and Dynamic Programming Beat Tracking", IEEE International Conference on Acoustics, Speech, and Signal Processing, 2007, pp. 1429-1432.
Jensen, Jesper Hojvang et al., "A Tempo-Insensitive Distance Measure for Cover Song Identification Based on Chroma Features", IEEE International Conference on Acoustics, Speech, and Signal Processing, 2008, pp. 2209-2212.

* cited by examiner

*Primary Examiner* — James K Mooney
(74) *Attorney, Agent, or Firm* — Lowenstein Sandler LLP

(57) ABSTRACT

A matrix is generated that stores sinusoidal components evaluated for a given sample rate corresponding to the matrix. The matrix is then used to convert an audio signal to chroma vectors representing of a set of "chromae" (frequencies of interest). The conversion of an audio signal portion into its chromae enables more meaningful analysis of the audio signal than would be possible using the signal data alone. The chroma vectors of the audio signal can be used to perform analyzes such as comparisons with the chroma vectors obtained from other audio signals in order to identify audio matches.

20 Claims, 5 Drawing Sheets

ACCURATE EXTRACTION OF CHROMA VECTORS FROM AN AUDIO SIGNAL

CROSS REFERENCE TO RELATED APPLICATION

This application is a continuation application of U.S. patent application Ser. No. 14/754,461, filed Jun. 29, 2015, which is related to and claims the benefit of U.S. Patent Application No. 62/018,634, filed on Jun. 29, 2014, both of which are incorporated herein by reference in their respective entireties.

BACKGROUND

1. Field of Art

The present invention generally relates to the field of digital audio, and more specifically, to ways of accurately extracting discrete notes from a continuous signal.

2. Description of the Related Art

A prerequisite for audio analysis is the conversion of portions of an audio signal (e.g., a song) into representations of their notes or "chromae," i.e., a set of frequencies of interest, along with magnitudes quantifying the relative strengths of the frequencies. For example, a portion of an audio signal could be converted into a representation of the 12 semitones in an octave. The conversion of an audio signal portion into its chromae enables more meaningful analysis of the audio signal than would be possible using the signal data alone.

Conventional techniques for extracting the chromae from an audio signal typically use a Discrete Fourier Transform (DFT) of the audio signal to produce a set of frequencies whose wavelengths are an integer fraction of the signal length and then map the frequencies of the DFT to the frequencies of the chromae of interest. Such a technique suffers from several shortcomings. First, the frequencies used in the DFT typically do not match the frequencies of the desired chromae, which leads to a "smearing" of the extracted chromae when they are mapped from the frequencies used by the DFT to the frequencies of the chromae, especially for sounds in lower frequencies. Second, computing the DFT for short portions of the audio signal requires dampening the signal at the beginning and end of the audio sample, a process called "windowing", to avoid artifacts caused by the non-periodicity of the audio sample. The windowing process further reduces the quality of the extracted chromae. As a result of the smearing and smoothing operations of the DFT, the values in the chromae lose accuracy. Analyses that use the chromae therefore suffer from diminished accuracy.

SUMMARY

In one embodiment, a computer-implemented method comprises obtaining an audio signal; segmenting the audio signal into a plurality of time-ordered audio segments; accessing a first matrix of sinusoidal functions evaluated over a plurality of frequencies corresponding to chromae to be evaluated; deriving a plurality of chroma vectors corresponding the plurality of time-ordered audio segments using the first matrix, a chroma vector indicating a magnitude of a frequency of the plurality of frequencies in the corresponding audio segment; comparing the derived chroma vectors to chroma vectors derived from a library of known audio items; responsive to the comparison, detecting a match of the derived chroma vectors with chroma vectors of a first one of the known audio items; and identifying the obtained audio signal as having audio of the first audio item.

In one embodiment, a non-transitory computer-readable storage medium has processor-executable instructions comprising instructions for obtaining an audio signal; instructions for segmenting the audio signal into a plurality of time-ordered audio segments; instructions for accessing a first matrix of sinusoidal functions evaluated over a plurality of frequencies corresponding to chromae to be evaluated; instructions for deriving a plurality of chroma vectors corresponding the plurality of time-ordered audio segments using the first matrix, a chroma vector indicating a magnitude of a frequency of the plurality of frequencies in the corresponding audio segment; instructions for comparing the derived chroma vectors to chroma vectors derived from a library of known audio items; instructions for responsive to the comparison, detecting a match of the derived chroma vectors with chroma vectors of a first one of the known audio items; and instructions for identifying the obtained audio signal as having audio of the first audio item.

In one embodiment, a computer system comprises a computer processor and a non-transitory computer-readable storage medium having instructions executable by the computer processor. The instructions comprise instructions for obtaining an audio signal; instructions for segmenting the audio signal into a plurality of time-ordered audio segments; instructions for accessing a first matrix of sinusoidal functions evaluated over a plurality of frequencies corresponding to chromae to be evaluated; instructions for deriving a plurality of chroma vectors corresponding the plurality of time-ordered audio segments using the first matrix, a chroma vector indicating a magnitude of a frequency of the plurality of frequencies in the corresponding audio segment; instructions for comparing the derived chroma vectors to chroma vectors derived from a library of known audio items; instructions for responsive to the comparison, detecting a match of the derived chroma vectors with chroma vectors of a first one of the known audio items; and instructions for identifying the obtained audio signal as having audio of the first audio item.

The figures depict embodiments of the present invention for purposes of illustration only. One skilled in the art will readily recognize from the following description that alternative embodiments of the structures and methods illustrated herein may be employed without departing from the principles of the invention described herein.

DETAILED DESCRIPTION

Figure 1:
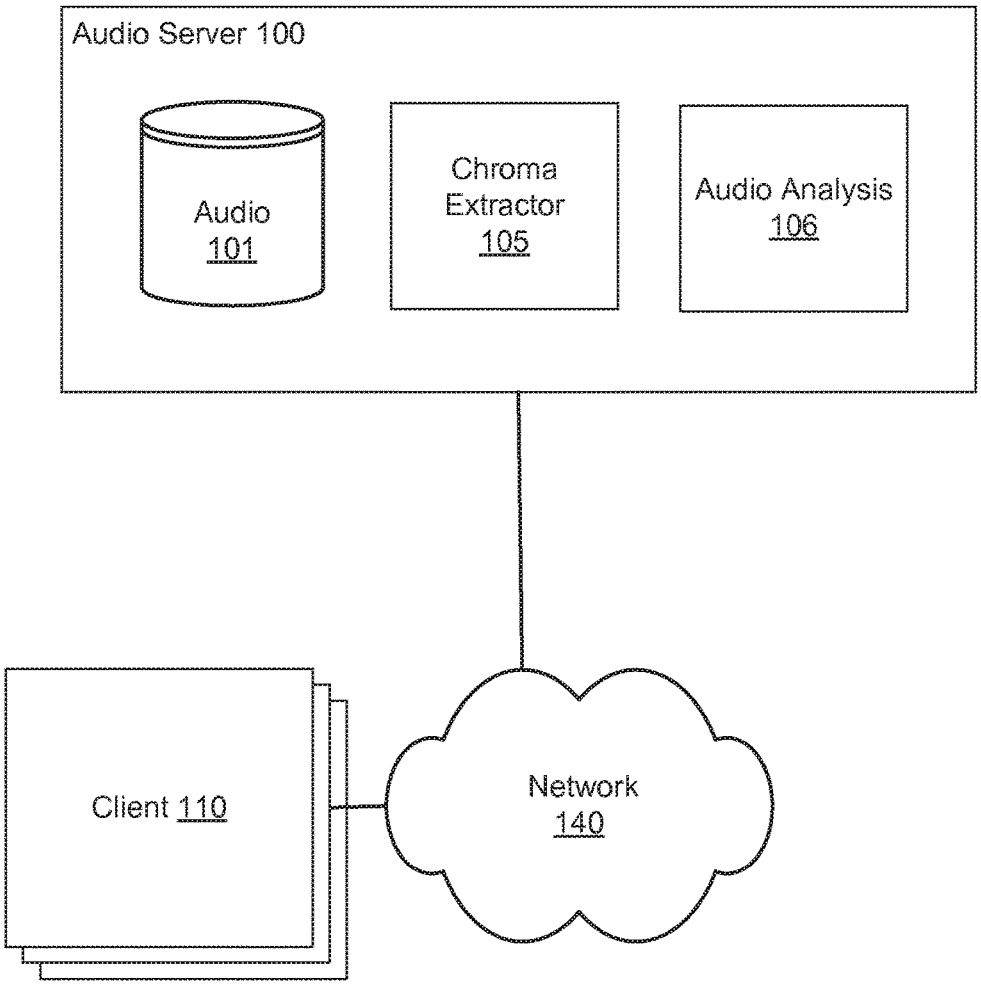
FIG. 1 illustrates a computing environment in which audio processing takes place, according to one embodiment.

FIG. 1 illustrates a computing environment in which audio processing takes place, according to one embodiment.

An audio server 100 includes an audio repository 101 that stores a set of different digital audio items, such as songs or speech, as well as an audio analysis module 106 that includes functionality to analyze and compare audio items, and a chroma extractor module 105 that extracts the chromae from the audio signals of the audio items. Users use client devices 110 to interact with audio, such as obtaining and playing the audio items from the audio repository 101, submitting queries to identify audio items, submitting audio items to the audio repository, and the like.

The audio server 100 and the clients 110 are connected via a network 140. The network 140 may be any suitable communications network for data transmission. The network 140 uses standard communications technologies and/or protocols and can include the Internet. In another embodiment, the network 140 includes custom and/or dedicated data communications technologies.

The audio items in the audio repository 101 can represent any type of audio, such as music or speech, and comprise metadata (e.g., title, tags, and/or description) and audio content. Each audio item may be stored as a separate file stored by the file system of an operating system of the audio server 100. The audio content is described by at least one audio signal, which produces a single channel of sound output for a given time value. The oscillation of the sound output(s) of the audio signal represent different frequencies. The audio items in the audio repository 101 may be stored in different formats, such as MP3 (Motion Picture Expert Group (MPEG)-2 Audio Layer III), FLAC (Free Lossless Audio Codec), or OGG, and may be ultimately converted to PCM (Pulse-Code Modulation) format before being played or processed. In one embodiment, the audio repository additionally stores the chromae extracted by a chroma extractor module 105 (described below) in association with the audio items from which they were extracted.

The audio analysis module 106 performs analysis of audio items using the functions of the chroma extractor 105. For example, the audio analysis module 106 can compare two different audio items to determine whether they are effectively the same. This comparison allows useful applications such as identifying an audio item by comparing the audio item with a library of known audio items. For example, the audio analysis module 106 may identify audio content embedded within an audio or multimedia file received at a content repository by comparing the audio content with a library of known content. (E.g., the chroma extractor 105 may extract chroma vectors from a specified audio item, and may compare the extracted chroma vectors to those of a library of chroma vectors previously extracted from known audio items. If the extracted chroma vectors match those of the library, the specified audio item is identified as having portions of audio content matching portions of the audio content of the known audio item from which the library chroma vectors were extracted. This may be used, for example, to detect duplicate audio items within the audio repository 101 and remove the duplicates; to detect audio items that infringe known copyrights; and the like.) As another example, the audio analysis module 106 in combination with the chroma extractor module 105 may be used to identify audio content played in a particular environment. For example, environmental audio from a physical environment (e.g., music playing in the background, or music vocalized by a human such as by whistling or humming) may be digitally sampled by the client 110 and sent to the audio server 100 over the network 140. The audio analysis module 106 may then identify music or other audio content present within the environmental audio by comparing the environmental audio with known audio.

Audio analysis is comparatively difficult to perform when working with the raw audio signals of audio items. Thus, in order to support audio analysis, the audio server 100 includes a chroma extractor module 105 that extracts chromae, i.e., a set of frequencies of interest, along with magnitudes representing their relative strengths. For example, in one embodiment the chroma extractor module 105 converts a portion of an audio signal into a representation of the 12 semitones in an octave.

Figure 2:
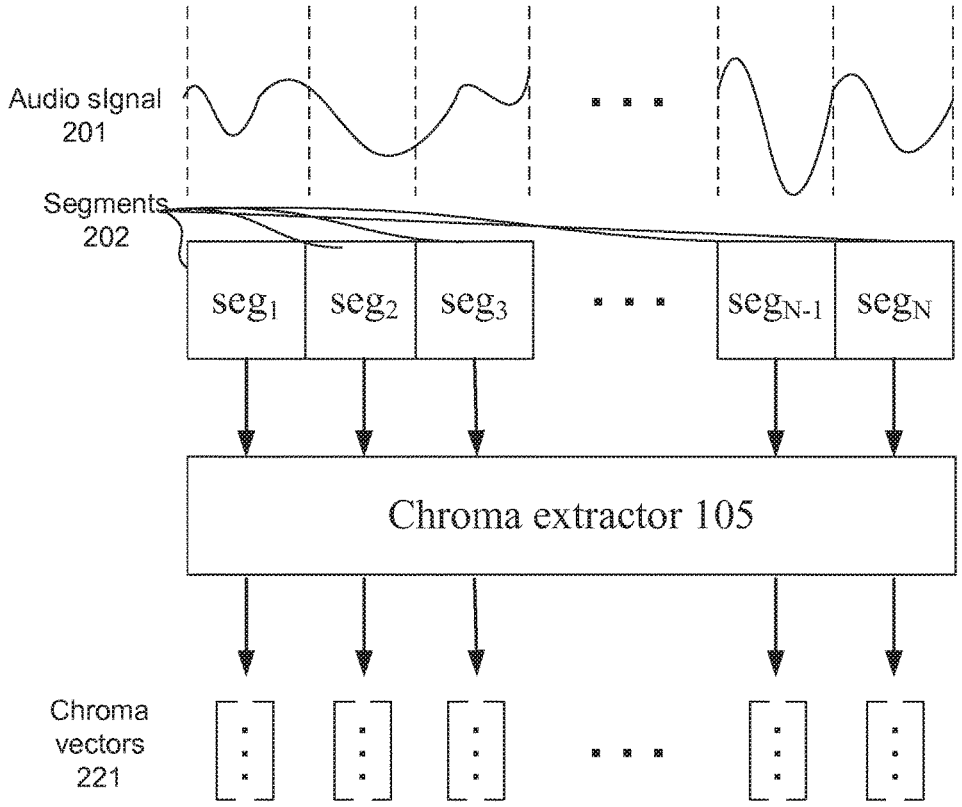
FIG. 2 illustrates the operation of the chroma extractor module of FIG. 1, according to one embodiment.

FIG. 2 illustrates the operation of the chroma extractor module 105 of FIG. 1, according to one embodiment. An audio item is represented by an audio signal 201, the data of which can be segmented into an ordered series of time interval segments 202, either by the chroma extractor module 105 itself or by another module. For each of the segments 202, the chroma extractor module 105 produces a corresponding chroma vector 221. Each chroma vector 221 has a magnitude value for each frequency of interest (e.g., the 12 frequencies corresponding to the 12 semitones in an octave). In one embodiment, the value is represented by an integer, a real number, or other number that allows representation of the relative magnitude of the corresponding chroma frequency with respect to other chroma frequencies in the segment.

Figure 3:
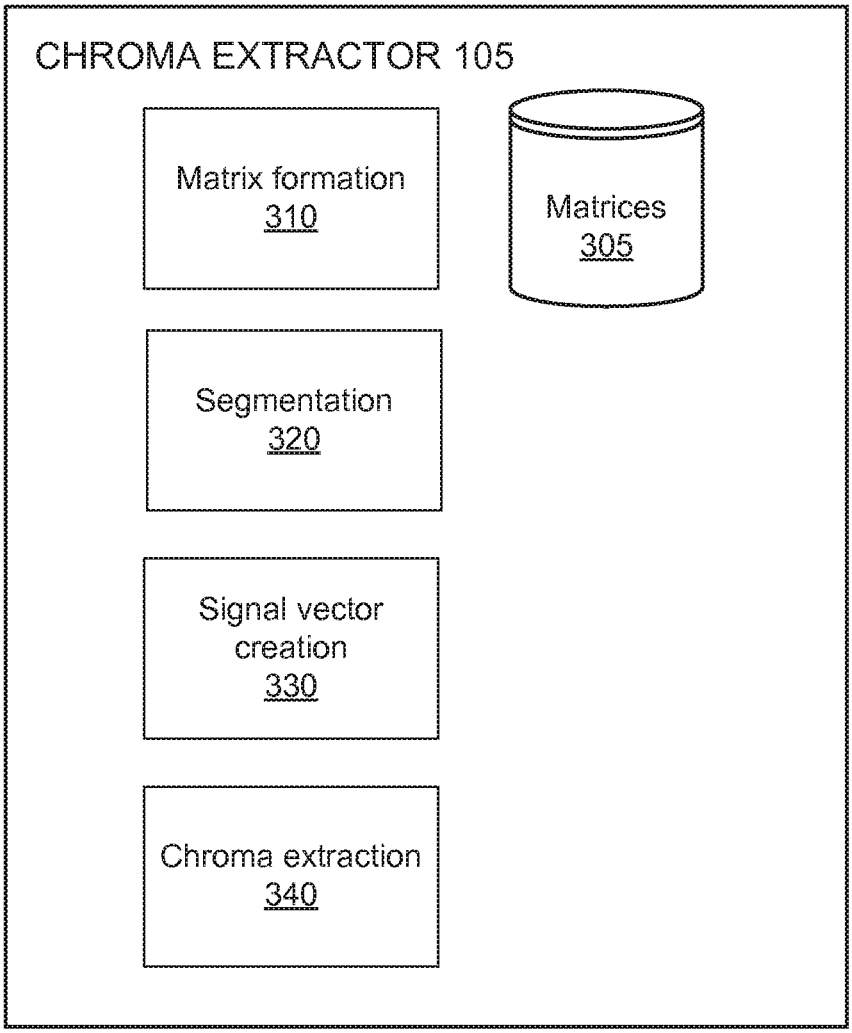
FIG. 3 is a high-level block diagram illustrating a detailed view of the chroma extractor module of FIG. 1, according to one embodiment.

FIG. 3 is a high-level block diagram illustrating a detailed view of the chroma extractor module 105 of FIG. 1, according to one embodiment.

The chroma extractor module 105 directly extracts the chroma frequencies of interest from a segment of an audio signal, avoiding the loss of accuracy inherent in a technique such as the DFT. Mathematically, the relationship of frequency, frequency magnitude, and signal is represented by the equation:

$$m_f = \int s(t) \cdot f(t)\,dt \qquad \text{(Eq'n 1)}$$

where $m_f$ denotes the magnitude coefficient of a particular chroma frequency f, s(t) denotes the value of the signal at a time t within the segment, and f(t) represents the frequency of the signal at time t.

Using an approximation based on the trapezoidal rule:

$$m_f \approx [s(t_i) \cdot f(t_i)] \qquad \text{(Eq'n 2)}$$

where $\Sigma''[s(t_i) \cdot f(t_1)]$ indicates the sum of the product $s(t_i) \cdot f(t_1)$ over N time points, where the first and last product terms are halved, as required for the trapezoidal rule. The values $t_i$ are based on the sampling rate. For example, if the sampling rate is 44,100 Hz, the values $t_i$ are spaced apart by $1/44{,}100$ of a second. The total number of time intervals N depends on the length of an audio segment and on the sampling rate—i.e., N=(segment length)*(sampling rate). For example, for a 50 millisecond segment and a sampling rate of 44,100 Hz, N=0.05*44,100=2,205.

Further:

$$c_f \approx \text{sqrt}(a_f^2 + b_f^2) \qquad \text{(Eq'n 3)}$$

where $$a_f = \Sigma'' s(t_i) \cdot \sin(\pi \cdot t_i / f) \qquad \text{(Eq'n 3.1)}$$

and $$b_f = \Sigma'' s(t_i) \cdot \cos(\pi \cdot t_i / f) \qquad \text{(Eq'n 3.2)}$$

Thus, the magnitude (denoted $c_f$) of any frequency f of interest—and not merely of the frequencies whose wavelengths are an integer fraction of the signal length—can be directly computed using a sum of products of signal values and sinusoidal functions. For example, the component $a_f = s(t_1)\cdot\sin(\pi\cdot t_1/f)/2 + s(t_2)\cdot\sin(\pi\cdot t_2/f) + \ldots + s(t_N)\cdot\sin(\pi\cdot t_N/f)/2$. The components $s(t_i)$ represent portions of the signal itself, whereas the components $\sin(\pi\cdot t_i/f)$ are signal-independent and can accordingly be computed once and applied to any signal that shares the same sampling rate and segment length based on which they were computed. Similarly, for the component $b_f = \Sigma''s(t_i)\cdot\cos(\pi\cdot t_i/f)$, the components $\cos(\pi\cdot t_i/f)$ are signal-independent and can be computed once and then applied to different signals sharing the given sampling rate and segment length.

Accordingly, in one embodiment the chroma extractor module 105 computes a matrix M that contains the values for the sinusoidal components of the frequency magnitude equation (3)—that is, the components $\sin(\pi\cdot t_i/f)$ and $\cos(\pi\cdot t_i/f)$ for the pluralities of frequencies f corresponding to the chroma frequencies of interest. The chroma extractor module 105 then extracts the chroma vector for a segment of an audio signal by applying the matrix to the signal values of the segment.

Thus, the chroma extractor 105 includes a matrix formation module 310 that generates a matrix M for a given sample rate (e.g., 44,100 Hz) and audio signal segment length (e.g., 50 milliseconds of data per segment), storing the matrix elements in a matrices repository 305. In one embodiment, the matrix formation module 310 is used to form and store a matrix M for each of a plurality of common sample rate and audio signal segment length pairs. In this embodiment, the segment lengths may be varied to accommodate the sample rates, such that the segment length is adequate to contain an adequate number of sample points, e.g., enough sample points to represent the lowest frequency of the chromae. In another embodiment, each audio item is up-sampled or down-sampled as needed to a single sample rate (e.g., 44,100 Hz), and the same signal segment length (e.g., 50 ms) is used for all the audio items, so only a single matrix is computed.

As one specific example of forming the matrix, the following code for the MATLAB environment forms the matrix M for a given sampling rate ("samplerate"), segment time length ("segmentlen"), and number of different chroma frequencies to evaluate per octave ("bins_per_octave"):

Code listing 1

```
N = segmentlen * samplerate        %Compute number of samples
t = [ 0:N-1 ] / samplerate %Create vector of times based on sample rate.
M = [ ] %Create empty matrix.
For k = -2:5 %8 octaves to sample around 440 Hz
  For j = 0:bins_per_octave-1
    freq = pi * t * 2^(k + j/ bins_per_octave) * 440; %Sampling around
    440 Hz
    M = [M ; sin(freq) ; cos(freq)]; %Append the sinusoid values to M.
  End
End
M(:,1) = M(:,1) * 0.5;        %Halve the first value.
M(:,end) = M(:,end) * 0.5; %Halve the last value.
```

In this particular implementation, the matrix M has (2*bins_per_octave*8) rows and N columns, storing the value of the components $\sin(\pi\cdot t_i/f)$ and $\cos(\pi\cdot t_i/f)$ for each of the N segment samples. The number of distinct chromae (frequencies) represented is (8*bins_per_octave), since 8 octaves are accounted for in the above code example.

It is appreciated that the matrix M could be generated in many ways, e.g., with many different programming languages, and with many different matrix dimensions. For example, the code of Code listing 1, above, generates a matrix with m=(8*bins_per_octive*2) rows and n=(segmentlen*samplerate) columns. It would also be possible (for example) to create the matrix M as a list of (m*n) rows and 1 column, however, with equivalent changes to the structure of any vector by which the matrix was multiplied. Similarly, the number of octaves to be evaluated could be other than 8.

The chroma extractor module 105 further comprises a segmentation module 320, a signal vector creation module 330, and a chroma extraction module 340 that, given an audio signal of an audio item, extract a corresponding set of chroma vectors using the computed matrix M.

The segmentation module 320 segments the audio signal into an ordered set of segments, based on the time length of the audio signal and the time length of the segments. For example, a 10 second audio signal that is segmented into segments of 50 milliseconds each will have (10 seconds)*(1000 milliseconds/second)*(segment/50 milliseconds)=200 segments from which chromae will be extracted.

The signal vector creation module 330 produces, for each segment, a segment signal vector that has a dimension compatible with the matrix M. Specifically, the signal vector creation module 330 converts the data corresponding to the segment into a vector of representative signal values $s(t_f)$, for each frequency f in the set of chromae to be analyzed.

The chroma extraction module 340 uses the computed matrix M to derive the chroma vector for each audio segment. More specifically, for each segment, the chroma extraction module 340 multiples the matrix M by the vector of signal values produced by the signal vector creation module 330 for that segment. The multiplication produces, for each chroma in the set of chromae to be analyzed, a value $a_f = \Sigma''s(t_i)\cdot\sin(\pi\cdot t_i/f))$ and a value $b_f = \Sigma''s(t_i)\cdot\cos(\pi\cdot t_i/f))$, for the frequency f corresponding to the chroma.

The computational expense of the multiplication is O(m*N), where m is the number of chromae extracted (e.g., 12 semitone frequencies) and N is the length of the audio signal (the number of samples for the audio signal). For sufficiently small audio signal segment sizes (e.g., 50 milliseconds), this is more computationally efficient than algorithms such as the Fast Fourier Transform used by the DFT.

The square root of the sum of the squares of $a_f$ and $b_f$ is then computed as in Eq'n 3, above, to obtain the value $c_f = \mathrm{sqrt}(a_f^2 + b_f^2)$ that represents the magnitude of the frequency f. In one embodiment, the magnitudes of corresponding chromae (e.g., the chromae corresponding to the note F# in different octaves) are summed together. This results in one value for each of the corresponding chroma sets, such as the 12 semitones of an octave.

For example, given the matrix M created by the above code (Code listing 1), the below example MATLAB code (Code listing 2) generates a vector c containing each $c_i$ value.

Code listing 2

```
c = M * signal    %Multiple matrix M by segment signal vector.
c = sqrt( c(1:2:end).^2 + c(2:2:end).^2 );    %Compute sqrt(a^2 + b^2)
c = sum(reshape( c, bins_per_octave, prod(size(c) / bins_per_octave), 2);
  %Sum the magnitudes of corresponding chromae-results in
bins_per_octave elements in vector c.
```

In some embodiments in which the audio server 100 (implemented in whole or in part using, e.g., the computer of FIG. 5, below) has dedicated matrix multiplication hardware, the chroma extractor 105 stores the elements M in the form of a matrix compatible with the matrix multiplication hardware, which allows the chroma extraction module 340 to achieve faster computations using the matrix (e.g., the computation to multiply M by a segment signal vector). It is appreciated, however, that the data of M and of the segment signal vector could be stored differently, such as in matrices of different dimensions, or in flat lists, as long as the chroma extraction module 340 performs operations that produce the same resulting chroma magnitude values as those produced by the above-described multiplication of M by the segment signal vectors.

Figure 4:
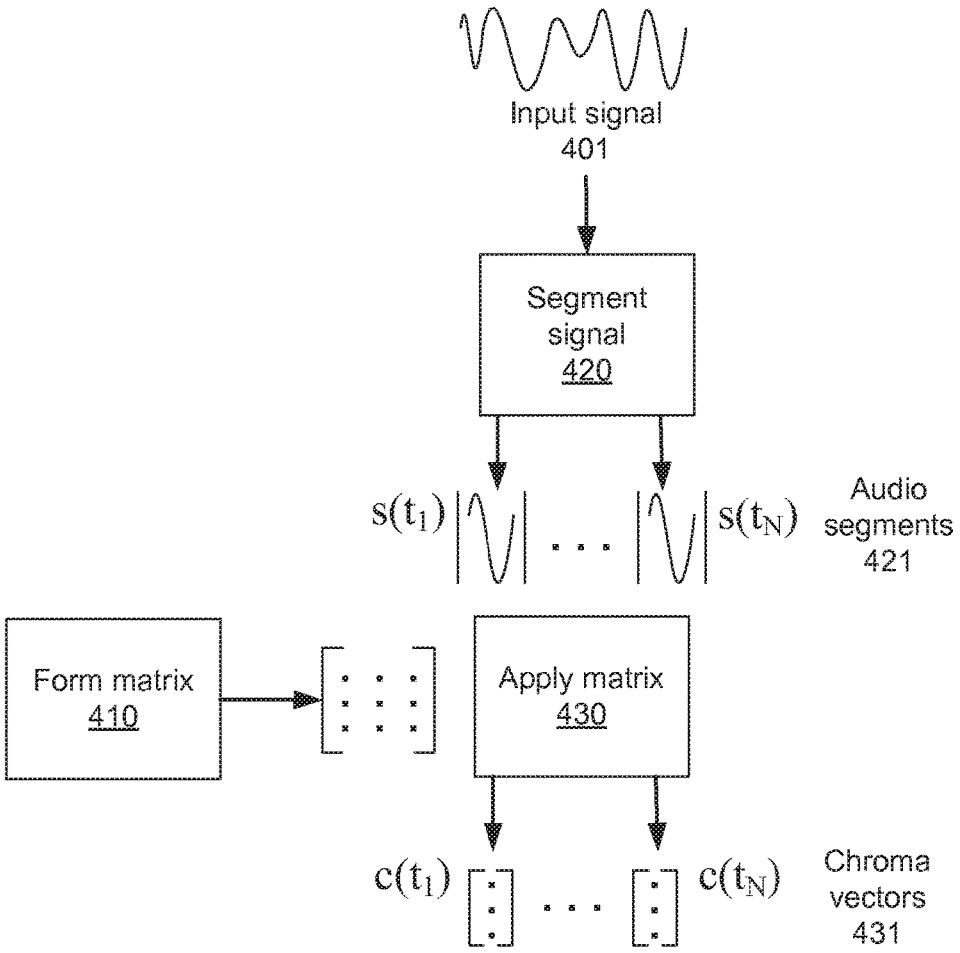
FIG. 4 is a data flow diagram illustrating the conversion by the chroma extractor module of an input signal into a set of chroma vectors, according to one embodiment.

FIG. 4 is a data flow diagram illustrating the conversion by the chroma extractor module 105 of an input signal 401 into a set of chroma vectors 431, according to one embodiment.

The chroma extractor module 105 forms 410 one or more matrices, each matrix corresponding to a particular sampling rate and segment time length. The computation of a matrix need not be in response to receiving an input signal 401. For example, in one embodiment, a matrix is pre-computed for each of multiple common sampling rate and segment time length combinations. In one embodiment, the matrices are created as described above with respect to the matrix formation module 310.

The chroma extractor module 105 obtains an input audio signal 401. The input audio signal 401 could be from an audio item stored in the audio repository 101, from an audio item received directly from a user over a network, or the like. The chroma extractor module 105 segments 420 the input audio signal 401 into a set of time-ordered audio segments 421, e.g., as described above with respect to the audio segmentation module 320. The chroma extractor module 105 also produces a segment signal vector for each audio segment, e.g., as described above with respect to the signal vector creation module 330.

The chroma extractor module 105 obtains chroma vectors 431 corresponding to the input audio signal 401, one chroma vector for each audio segment, by accessing the appropriate matrix formed by the matrix formation module 310 and applying 430 that matrix to the chroma vectors. For example, the chroma extractor module 105 could determine the sampling rate of the input audio signal and select a matrix formed for that particular sampling rate. The selected matrix is multiplied by each of the segment signal vectors to produce the set of chroma vectors 431, e.g., as described above with respect to the chroma extraction module 340.

The chroma vectors 431 characterize the audio signal 401 in a higher-level, more meaningful manner than the raw signal data itself and allow more accurate analysis of the audio signal. For example, the audio analysis module 106 of FIG. 1 can use the chroma vectors 431 to compare two audio signals, or portions thereof, for similarity. Multiple comparisons may be made in order to identify a match of an audio item within a library of known audio items. For example, chroma vectors may be derived from a given audio item (which may or may not be in a library of known audio items, for example), and also from other audio items in the library. The chroma vectors of the given audio item may be compared to those of the other audio items, and if there is a match, the audio item from which the obtained audio items were derived is identified (e.g., as having audio of the given audio item).

As previously explained, the direct computation of the chroma vectors using Equation 3, above, results in more accurate chroma values than would be obtained by (for example) the use of a DFT. For example, the direct computation described above avoids the need to convert the values for the particular frequencies analyzed by the DFT to the frequencies of the chromae of interest, which results in greater accuracy. Further, direct computation does not require the signal smoothing required by the DFT, which particularly leads to inaccuracies for small segments of data. The accuracy of the extracted chroma values is thus enhanced due to reduction of error, as well as the ability to compute chromae for smaller segments, leading to greater "resolution" of the chromae. The computation time required for matrix-vector multiplication also compares favorably in practice to the time required by a DFT, given that the signal segments are relatively small and hence the matrix multiplication has relatively few elements.

Figure 5:
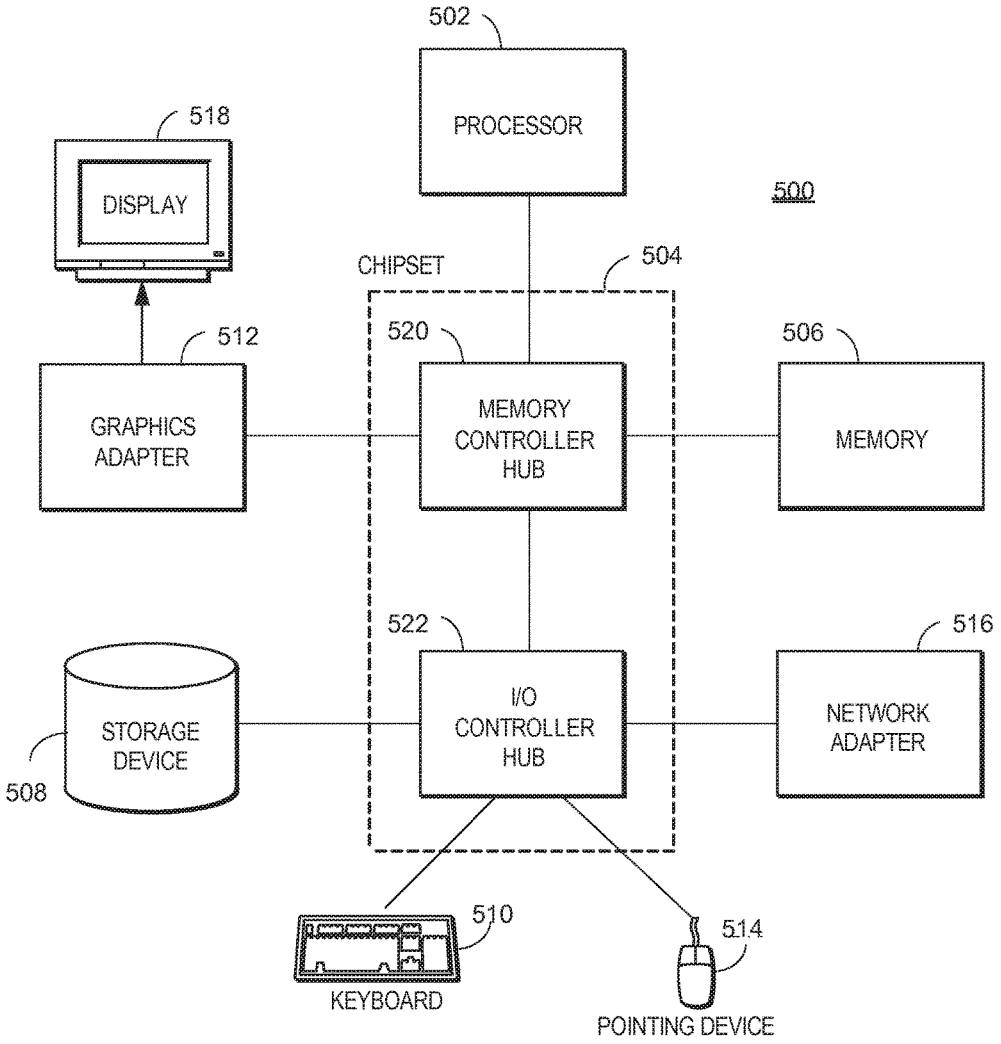
FIG. 5 is a high-level block diagram illustrating physical components of a computer used as part or all of the audio server or client from FIG. 1, according to one embodiment.

FIG. 5 is a high-level block diagram illustrating physical components of a computer 500 used as part or all of the audio server 100 from FIG. 1, according to one embodiment. Illustrated are at least one processor 502 coupled to a chipset 504. The processor 502 or other components of the computer 500 may include dedicated matrix multiplication hardware to improve processing of the matrix operations performed by the chroma extractor module 105. Also coupled to the chipset 504 are a memory 506, a storage device 508, a keyboard 510, a graphics adapter 512, a pointing device 514, and a network adapter 516. A display 518 is coupled to the graphics adapter 512. In one embodiment, the functionality of the chipset 504 is provided by a memory controller hub 520 and an I/O controller hub 522. In another embodiment, the memory 506 is coupled directly to the processor 502 instead of the chipset 504.

The storage device 508 is any non-transitory computer-readable storage medium, such as a hard drive, compact disk read-only memory (CD-ROM), DVD, or a solid-state memory device. The memory 506 holds instructions and data used by the processor 502. The pointing device 514 may be a mouse, track ball, or other type of pointing device, and is used in combination with the keyboard 510 to input data into the computer 500. The graphics adapter 512 displays images and other information on the display 518. The network adapter 516 couples the computer 500 to a local or wide area network.

As is known in the art, a computer 500 can have different and/or other components than those shown in FIG. 5. In addition, the computer 500 can lack certain illustrated components. In one embodiment, a computer 500 acting as a server may lack a keyboard 510, pointing device 514, graphics adapter 512, and/or display 518. Moreover, the storage device 508 can be local and/or remote from the computer 500 (such as embodied within a storage area network (SAN)).

As is known in the art, the computer 500 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 508, loaded into the memory 506, and executed by the processor 502.

Other Considerations

The present invention has been described in particular detail with respect to one possible embodiment. Those of skill in the art will appreciate that the invention may be practiced in other embodiments. First, the particular naming of the components and variables, capitalization of terms, the attributes, data structures, or any other programming or structural aspect is not mandatory or significant, and the mechanisms that implement the invention or its features may have different names, formats, or protocols. Also, the particular division of functionality between the various system components described herein is merely for purposes of example, and is not mandatory; functions performed by a single system component may instead be performed by multiple components, and functions performed by multiple components may instead performed by a single component.

Some portions of above description present the features of the present invention in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by real time network operating systems.

The algorithms and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, the present invention is not described with reference to any particular programming language. It is appreciated that a variety of programming languages may be used to implement the teachings of the present invention as described herein, and any references to specific languages are provided for invention of enablement and best mode of the present invention.

The present invention is well suited to a wide variety of computer network systems over numerous topologies. Within this field, the configuration and management of large networks comprise storage devices and computers that are communicatively coupled to dissimilar computers and storage devices over a network, such as the Internet.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

What is claimed is:

1. A computer-implemented method comprising:

obtaining an audio signal;

segmenting the audio signal into a plurality of audio segments;

deriving a first plurality of chroma vectors corresponding to the plurality of audio segments, each of the chroma vectors indicating a magnitude of a frequency of a plurality of frequencies available for a corresponding audio segment, wherein the magnitude is derived in view of a first set of values independent of the audio signal;

comparing the first plurality of chroma vectors to a second plurality of chroma vectors derived from a first known audio item to detect a match of the first plurality of chroma vectors with the second plurality of chroma vectors; and identifying the obtained audio signal as having audio of the first known audio item.

2. The computer-implemented method of claim 1, wherein the first plurality of chroma vectors are derived by using sinusoidal functions.

3. The computer-implemented method of claim 1, wherein the first plurality of chroma vectors are derived in view of a sample rate of the obtained audio signal.

4. The computer-implemented method of claim 1, wherein the plurality of audio segments comprises an ordered series of time interval segments.

5. The computer-implemented method of claim 1, wherein the magnitude of the frequency of the plurality of frequencies is derived in further view of a second set of values dependent on the audio signal.

6. The computer-implemented method of claim 1, wherein the first set of values is derived by evaluating sinusoidal functions over a set of frequencies.

7. The computer-implemented method of claim 6, wherein the set of frequencies correspond to chromae to be evaluated.

8. The computer-implemented method of claim 1, wherein the first set of values is derived in view of a given sample rate.

9. The computer-implemented method of claim 1, wherein the first set of values is derived in view of an audio segment length.

10. The computer-implemented method of claim 1, further comprising creating a matrix of values comprising the first set of values.

11. A system comprising:

a memory; and a processor communicably coupled to the memory, the processor to:

obtain an audio signal;

segment the audio signal into a plurality of audio segments;

derive a first plurality of chroma vectors corresponding to the plurality of audio segments, each of the chroma vectors indicating a magnitude of a frequency of a plurality of frequencies available for a corresponding audio segment, wherein the magnitude is derived in view of a first set of values independent of the audio signal;

compare the first plurality of chroma vectors to a second plurality of chroma vectors derived from a first known audio item to detect a match of the first plurality of chroma vectors with the second plurality of chroma vectors; and identify the obtained audio signal as having audio of the first known audio item.

12. The system of claim 11, wherein the first plurality of chroma vectors are derived by using sinusoidal functions.

13. The system of claim 11, wherein the first plurality of chroma vectors are derived in view of a sample rate of the obtained audio signal.

14. The system of claim 11, wherein the plurality of audio segments comprises an ordered series of time interval segments.

15. The system of claim 11, wherein the magnitude of the frequency of the plurality of frequencies is derived in further view of a second set of values dependent on the audio signal.

16. The system of claim 11, wherein the first set of values is derived by evaluating sinusoidal functions over a set of frequencies.

17. The system of claim 11, wherein the first set of values is derived in view of a given sample rate.

18. The system of claim 11, further comprising creating a matrix of values comprising the first set of values.

19. A non-transitory computer-readable storage medium storing instructions which, when executed, cause a processor to:

obtain an audio signal;

segment the audio signal into a plurality of audio segments;

derive a first plurality of chroma vectors corresponding to the plurality of audio segments, each of the chroma vectors indicating a magnitude of a frequency of a plurality of frequencies available for a corresponding audio segment, wherein the magnitude is derived in view of a first set of values independent of the audio signal;

compare the first plurality of chroma vectors to a second plurality of chroma vectors derived from a first known audio item to detect a match of the first plurality of chroma vectors with the second plurality of chroma vectors; and identify the obtained audio signal as having audio of the first known audio item.

20. The non-transitory computer-readable storage medium of claim 19, wherein the magnitude of the frequency of the plurality of frequencies is derived in further view of a second set of values dependent on the audio signal.

* * * * *